United States Patent [19]

Rocha

[11] 4,038,904

[45] Aug. 2, 1977

[54] CARTRIDGE FEED, POSITIONING AND EJECTION CONTROL SYSTEM

[75] Inventor: John G. Rocha, Davenport, Iowa

[73] Assignee: The United States of America as represented by the Secretary of the Army, Washington, D.C.

[21] Appl. No.: 701,459

[22] Filed: June 30, 1976

[51] Int. Cl.[2] ..... F41D 9/02

[52] U.S. Cl. ..... 89/33 MC; 89/11; 89/33 C

[58] Field of Search ..... 42/15, 39.5; 89/1.801, 89/1.805, 1.815, 9, 11, 17, 33 MC, 155

[56] References Cited

U.S. PATENT DOCUMENTS

| | | | |
|---|---|---|---|
| 3,303,744 | 2/1967 | Lanizzani | 89/9 |
| 3,713,240 | 1/1973 | Goldin | 42/15 |

*Primary Examiner*—Stephen C. Bentley

*Attorney, Agent, or Firm*—Nathan Edelberg; Harold H. Card, Jr.; Robert O. Richardson

[57] ABSTRACT

A cartridge feed, positioning and ejection control system for automatic weapons having a reciprocable firing chamber.

Stepped cam paths on a rotatable cam actuator control sequential operation of a feed stop pawl and an ejection stop pawl synchronized to movement of the firing chamber to produce the feed, etc., functions.

13 Claims, 5 Drawing Figures

CARTRIDGE FEED, POSITIONING AND EJECTION CONTROL SYSTEM

GOVERNMENT RIGHTS

The invention described herein may be manufactured and/or used by or for the Government for governmental purposes without the payment of any royalty thereon.

BACKGROUND OF THE INVENTION

Generally, in prior art automatic weapon systems, the cartridge or round is introduced into the receiver and ramped angularly into the stationary firing chamber. Angular ramping has been heretofore required, in most cases, because of the configuration of the cartridge and its position in the linked belt on the feed tray. As a result, the ammunition feed and ejection mechanism designs were slaved to the design of the feed tray, firing chamber, reciprocating bolt and cartridge.

Recently, consideration has been given to the concept of a reciprocating firing chamber for automatic weapons which would telescope over the round for firing thereof. Such concept, while permitting lateral or transverse feed to, and ejection from, a receiver opening in the path of movement of the firing chamber, presented problems with respect to synchronization of the movement of the firing chamber between the in and out of battery positions with the feed and ejection functions as well as problems of axial centering of the round in the receiver for pickup by the reciprocable firing chamber in moving to the in battery position. To this end, various mechanical spring biased round centering mechanisms have been proposed as well as spring actuated feed and ejection devices. However, the effects of vibrations and recoil forces adversely affect operation of the spring biased devices, causing failures to feed and weapon stoppages.

SUMMARY OF THE INVENTION

By employment of the present invention, these and other problems, difficulties and disadvantages of the prior art are substantially overcome by the provision of a cartridge feed, positioning and ejection control system including a two-level or two tiered surfaced rotatable cam actuator member coaxial or concentric with the weapon receiver ammunition opening, a first feed pawl means that drives the cartridge to be fired laterally into the ammunition opening in the receiver, a second stop pawl means that functions at the ejection opening as a round locating stop, a first cam follower for one of said cam actuator surfaces which actuates the feed pawl means to pivot and move the cartridge to be fired into the ammunition opening, and a second pawl cam follower, which is synchronized with the movement of the first cam follower, for the other of the cam surfaces to actuate the second stop pawl means to cooperate with the feed pawl means to momentarily stop lateral movement of the round and position the round in the ammunition opening for positive pickup by the reciprocable firing chamber. The dual cam raceway or path designs of the cam actuator member are of configruations coordinated so that sequencing of the movements of the cam followers, and thus the pawls, cycle the feed of the ammunition into and out of the ammunition opening automatically in response to movement of the firing chamber.

The reciprocating firing chamber is constructed with integral platforms, or a bifurcated extension, so that, when the firing chamber is drawn away from the barrel to the out of battery position, the platforms act as control guides for centering of the incoming cartridge. As the firing chamber closes in, moving to the in battery position, these platforms straddle the barrel, as the round is being chambered for firing.

The cam actuator member is provided to coordinate coaction of the feed pawl and the round stop pawl so that the coaction of these assemblies is also synchronized with the movement of the reciprocating firing chamber, whereby the pawls temporarily hold the cartridge positioned in the center line fo the receiver while the firing chamber is starting its forward, or closing, motion to the in battery position. As the firing chamber telescopes over the cartridge case in approaching its firing position, it moves a sufficient distance to assume chambering control over the cartridge. The pawls move away from the cartridge and out of the path of the moving firing chamber permitting the firing chamber to pass through the receiver opening to its firing position enclosing the cartridge therewith. The bolt is spring loaded to bear against the base of the cartridge case effecting yet further control of the cartridge as the firing chamber moves to its in battery position.

DESCRIPTION OF THE DRAWINGS

These and other features, objects, and advantages of the present invention will become readily apparent to one skilled in the art from a study of the following description of a preferred embodiment of the invention, when read in conjunction with the accompanying drawing, wherein like reference numerals refer to like and corresponding parts throughout the several views, and wherein.

DESCRIPTION OF A PREFERRED EMBODIMENT

Figure 1:
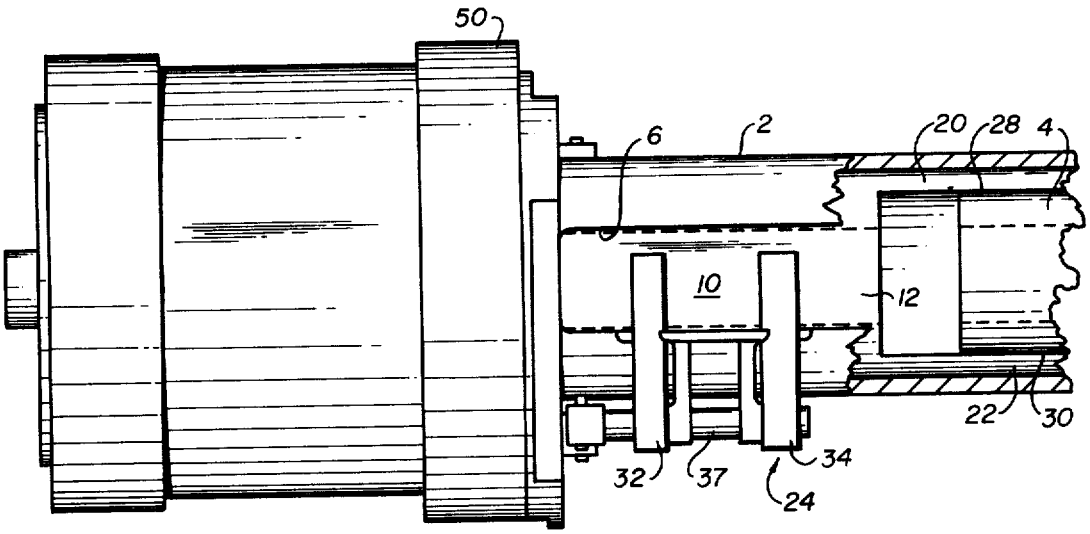
FIG. 1 is a side view in partial section of an automatic weapon system incorporating features of the present invention.

In FIG. 1 is disclosed a weapon system incorporating the features of the present invention. The weapon system includes a receiver 2, a barrel 4, an intermediate round receiving or feed opening 6 in the receiver and a receiver round ejection opening 8.

A firing chamber 10 is reciprocably movable linearly in the receiver between an out of battery position an out of battery position and an in battery position. External means (not shown) are provided to reciprocate the firing chamber 10 between these positions and cause continuous reciprocation of the firing chamber between said positions programmed (1) to the timing between firings, (2) to the timing of feed and ejection of rounds and (3) to the timing of centering of each round for capture by the firing chamber. In the full in battery position, the firing chamber 10 acts as a closure for both the feed and ejection outlets 6 and 8. The firing chamber 10 is cylindrical and includes a round receiving bore 12.

The firing chamber at its breech end carries a conventional bolt and firing pin mechanism to the in battery position.

Figure 3:
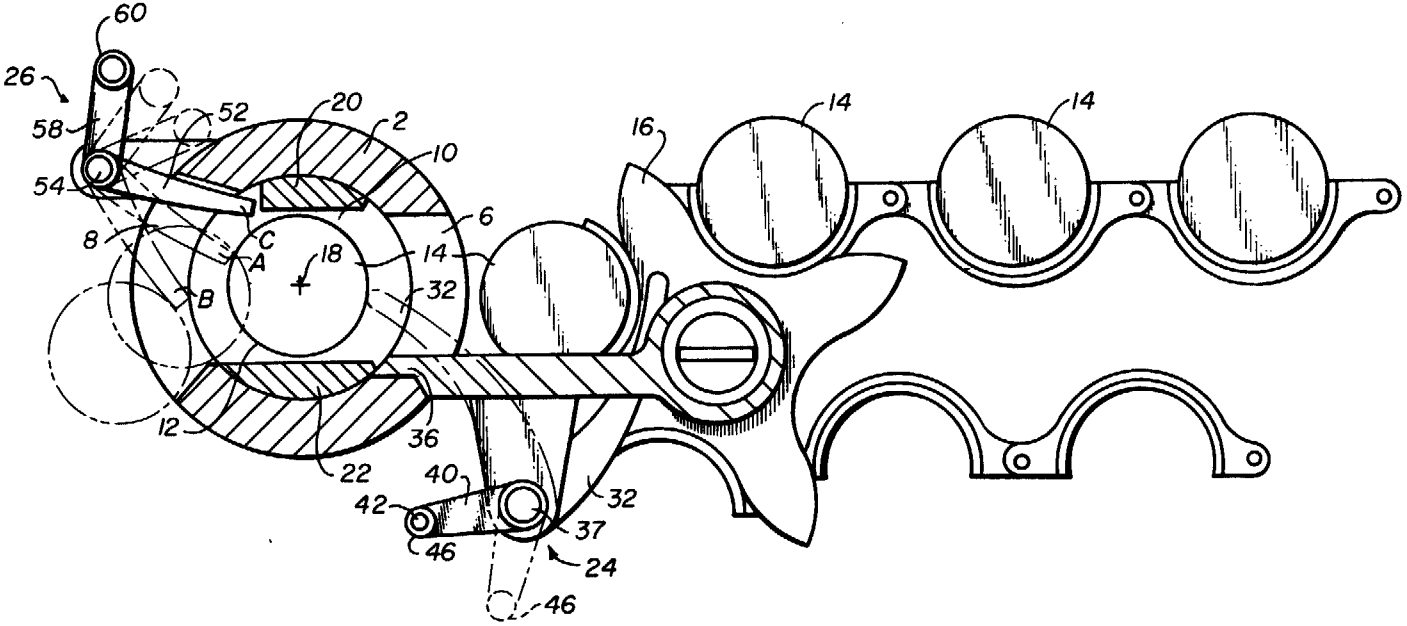
FIG. 3 is a schematic view illustrating a feed mechanism cooperating with the present invention to feed, position and eject rounds from the system of FIG. 1.

Rounds 14 are sequentially fed into the feed inlet 6 of the receiver laterally from such means as the round conveyor sprocket assembly 16 shown in FIG. 3. The rounds are initially positioned coaxial with the centerline 18 of the receiver, FIG. 3, by means of the coaction of a pair of extensions 20 and 22 provided on the firing chamber and the feed and ejection stop mechanisms 24 and 26 of the present invention, the structure and operation of which is hereinafter described. Once so positioned, the feed and ejection stop mechanisms 24 and 26 move laterally out of the path of movement of the firing chamber, and the firing chamber, moving into the in battery position, captures the centered round 14 in its axial bore 12 to permit the firing pin to fire the round.

Recoil movement of the firing chamber is synchronized with the operation of the feed mechanism 24 to cause feeding of the next round into the receiver feed opening 6 after the firing chamber has moved from the feed and ejection openings 6 and 8. The round being fed into the receiver opening causes lateral displacement of the spent casing out of the ejection opening 8 of the receiver. The extensions 20 and 22 on the firing chamber again cooperate with the feed mechanism 24 and ejection outlet stop mechanism 26 to center the second round for capture by the bore 12 of the firing chamber. When the firing chamber is again in full in battery position, the firing cycle is repeated automatically.

The pair of spaced extensions 20 and 22 on the firing chamber are each semi-cylindrical in cross section (FIG. 3) and are utilized to act as upper and lower guides for initially positioning each round in the receiver opening substantially coaxial with the firing chamber 10. To this end, the extensions 20 and 22 are of a length sufficient to permit positioning thereof in the receiver center 18 when the firing chamber is in the out of battery position (FIG. 1) and the barrel is correspondingly cut away as at 28 and 30 to accomodate the extensions when the firing chamber is in the in battery position as shown in FIG. 1.

Figure 2:
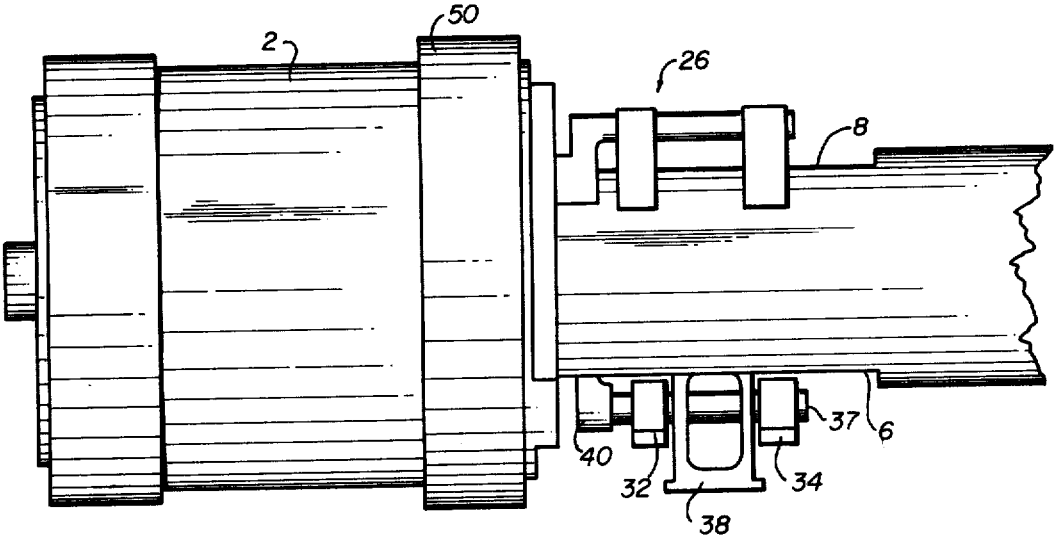
FIG. 2 is a top view of the system of FIG. 1.

The round feed mechanism 24 of the present invention, as shown in the drawing, comprises a pair of spaced arcuate pawls 32 and 34, one on each side of the feed tray platform 36. The pawls 32 and 34 are pivotally joined for movement together by means of a rod 37 (FIGS. 1 and 2) which extends through and is supported by a U-shaped bracket 38 which is the feed platform 36 mounted to the receiver 2. At its end adjacent to the breech of the weapon, the feed pawl 32 carries a laterally extending cam follower 40 which includes a pin 42 and rotatable roller 46 adapted to follow an upper cam path 48 defined by a rotatable transverse cam actuator 50 to cause pivotable movement of the feed pawls 32 and 34 between the stop position shown by the dotted line in FIG. 3 and the feed solid line position indicating that the feed pawls are out of the path of movement of the firing chamber.

The feed pawl 24 cooperates with the pivotable ejection pawl mechanism 26 which in one position, A, holds the round axially in the receiver on the firing chamber extensions 20 and 22 to center the round for capture by the firing chamber bore 12 while the firing chamber is moving to the in battery position. In a second position, B, the ejection stop pawl assembly 26 is pivoted out of the path of movement of the firing chamber as the firing chamber moves to the in battery position. In a third position, C, the ejection stop pawl assembly 26 is pivotally moved upwardly permitting ejection of the spent round.

The ejection stop pawl mechanism 26 includes a pawl member 52 having a pivot pin 54 extending through a bracket mounted to the receiver. At its breech end the pin 54 fixedly carries a cam arm 58. The cam arm 58 has a cam follower roller 60 positioned to ride in a second or lower cam path 62 on the rotatable cam actuator 50 that pivots the ejection stop pawl 52 between the three aforementioned positions. The cam action of the ejection stop pawl 52 is synchronized to the movement of the feed pawls 32 and 34.

The cam actuator 50 is rotated unidirectionally and continuously by external means (not shown). The rate of rotation of the cam actuator 50 is synchronized to the timing sequence of the firing chamber 10.

Figure 4:
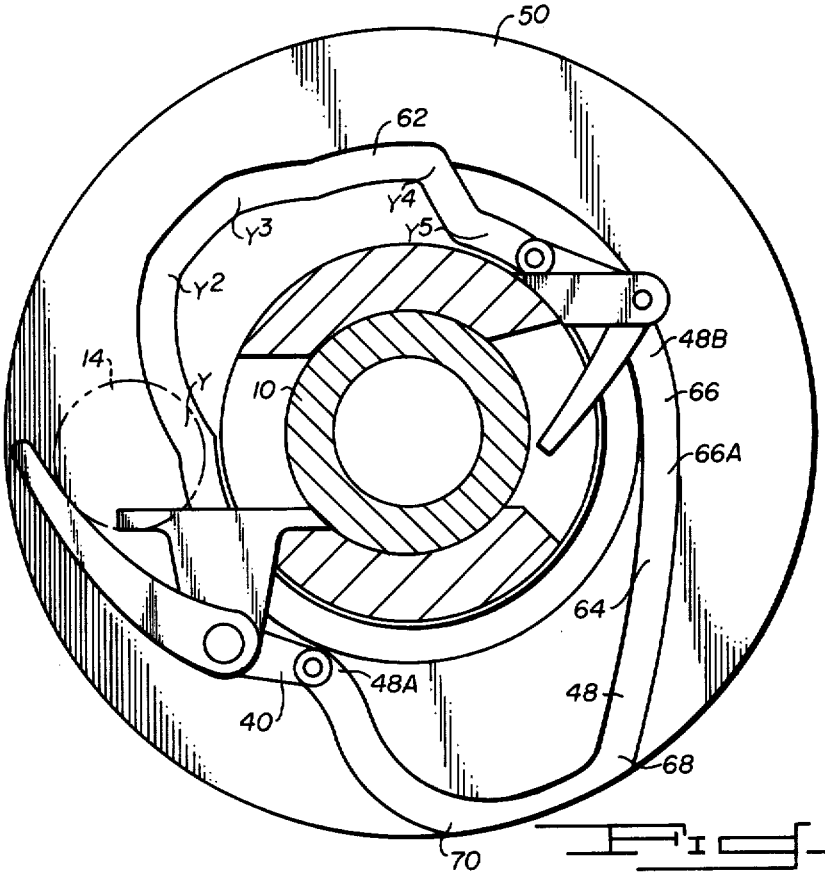
FIG. 4 is a schematic illustration of the cam actuator of the present invention.

As seen in FIG. 4, the cam actuator 50 if stepped in cross section to provide the first upper cam path 48 and the second lower cam path 62.

The first upper cam path 48 provides means for imparting pivoting motion to the feed pawls to cause movement thereof between the two positions and the second lower cam path 62 provides means for imparting pivoting motion to the ejection stop pawl 52 to cause movement thereof between its three positions.

When the feed pawls 32 and 34 are in the position X shown by the full line in FIG. 3, cam follower 40 is in the position shown in contact with the cam acutator 50. Continued rotation of the cam actuator 50 guides the feed pawl cam follower 40 a predetermined distance against a wall section 64 of the upper cam path 48. When the cam follower 40 reaches point A (FIG. 4) it then idles or floats over portions B and C of the stop pawl cam groove 62 and continues to idle from point 48A to point 48B where the cam follower 40 then enters the grooved portion 66 of the cam path 48 and continued to idle. When the moving cam actuator reaches point 66A the change in contour of the cam groove 66 changes the direction or movement of the cam follower 40 which causes the feed pawl to begin its round feed stroke. When the cam follower 40 reaches point 68 the change in contour of the cam path groove 66 holds the feed pawl 40 in the stop position, shown by dotted lines in FIG. 4, until the cam groove contour again changes at point 70 whereupon the cam follower 40 pivots the feed pawl back to the inactive position X. Continued rotation of the cam actuator 50 moves the cam roller out of the groove 66 of the cam path 48 at point 70, and when the cam actuator returns to point X again initiates repetitions of the foregoing feed and stop cycle of the feed pawl mechanism 24.

The configuration of the lower cam pathway 62 which is a continuous groove in the surface of the cam actuator 50 is contoured so that pivotable movement and position sequencing of the ejection stop pawl 26 is synchronized with the pivotable movement and position sequencing of the feed pawl 24.

The ejection stop pawl 26 has three positions: (1) The initial position assumed during the time periods of movement of the firing chamber to the in battery position, firing of the round, and return of the firing chamber to the out of battery position; (2) A second position to permit ejection of the spent round; and (3) A third position to which the ejection pawl is pivoted to assist the feed pawl in centering the succeeding round.

At the initiation of a firing cycle the ejection stop pawl 26 is located in the limiting position Y shown in full lines in FIG. 3 with the cam follower roller 60 in the surface cam groove position shown. During the time period in which the firing chamber is moving to and from the in battery position, the cam follower roller dwells or idles in the cam groove 62 to point Y. At point $Y^2$ the contour of the cam groove 62 changes and the cam follower 58 begins to pivot the ejection stop pawl 52 to its other limiting position to permit ejection of the spent round. After the spent round is ejected, the cam actuator 50 has pivoted to a point where the contour of the cam groove 62 changes again. Beginning at point $Y^3$ the cam follower 58 initiates pivoting of the ejection stop pawl 52 to its intermediate position to perform its round stop function in conjunction with the feed pawl which is now in its round stop position. After the stop function is completed, the contour of the cam groove again changes at point $Y^4$ and the cam follower 58 causes the ejection stop pawl to return to its initial limiting position out of the path of movement of the firing chamber into battery. After the cam groove 62 reaches point $Y^5$, continued rotation of the cam actuator 50 initiates repetitions of the foregoing three position cycling of the ejection stop pawl as long as the cam actuator 50 rotates.

The determination of the cam path profiles chosen depends on the geometry of the weapon system in which the cartridge control system of the present invention is employed.

The firing circuit controls the firing function and hence the out of battery position in which the firing chamber comes to rest upon opening of the firing circuit to terminate firing. Since the cam actuator rotational movement is synchronized, and thus the positions of the feed stop and ejector stop pawls, with the positions of the firing chamber, the feed stop pawl will be in its initial position and the ejector stop pawl in its uppermost limiting position, when the weapon is at rest.

In operation assuming the weapon system has just received a signal to commence firing, means (not shown) initiates rotation of the double cam actuator 50. Rotation of the double cam actuator commences pivotal movement of the feed pawl to feed a round into the empty round opening of the receiver and onto the upper and lower extensions of the firing chamber which prevents substantial vertical displacement of the round. During the greater period of movement of the feed pawl, the ejection stop pawl cam follower is idling on its uppermost limiting position FIG. 3 holding the ejection stop pawl out of the path of the cartridge case being ejected. Towards the end of the movement of the feed pawl from its other limiting initial round pickup position to the completion of the feed stroke, the feed cam groove configuration locks the feed pawl in its stop position, while the position of the ejection stop pawl changes to permit movement of the ejection stop pawl to its intermediate stop position in the receiver opening. The round in the receiver opening is thus contacted and now held by the feed pawl and ejection stop pawl against transverse movement and substantially in the centerline or coaxial with the firing chamber. During the time period in which the feed pawl and ejection stop pawl hold the round against movement laterally, means (not shwon) are programmed to initiate movement of the firing chamber toward its in battery position. Such movement of the firing chamber drives the firing chamber extensions 22 and 24 forwardly and progressively increases the degree of control the extensions have on positioning of the round.

Upon commencement of movement of the firing chamber to the in battery position and while the chamber begins telescoping over the base of the round, the cam configurations of the moving cam actuator 50 cause the feed pawl and ejection stop pawl to pivot from the path of movement of the firing chamber, the feed pawl eventually being returned to its initial feed position and the ejection stop pawl being returned to its initial limiting position. The feed pawl and stop ejector cam followers now idle or dwell in the cam actuator X raceways. The bolt carried firing mechanism is now actuated by means (not shown) to fire the round. A feature of the present invention resides in the fact that the tolerance between the round and reciprocable firing chamber need not be as fine as with conventional stationary firing chambers because the round firing pressure causes the cartridge case to expand to whatever configuration the chamber was fabricated. The round may be permitted some longitudinal play or movement thereby reducing considerably manufacturing costs of both round and weapon.

After the firing chamber 10 begins its movement in the recoil direction, the feed and ejection stop control cam followers continue in the grooved portions of their programmed tracks or raceways in the cam actuator 50. The ejection pawl is pivotally moved to its uppermost limiting position to permit ejection of the spent round casing through contact by the next round being fed into the receiver opening on to the extensions of the firing chamber. The feed pawl is pivoted to its initial limiting position in response to movement of its feed cam follower in the corresponding grooved portion of its programmed track in the cam actuator. Continued rotation of the cam actuator 50 will pivot the feed pawl to initiate movement of the next round into the receiver opening and to effect displacement of the casing of the spent round through the ejection outlet 8. After ejection of the casing of the spend round, the above-described stop functions of the feed and ejection stop pawls are synchronized to the in battery linear movement of the firing chamber. Subseqently the feed and ejection stop pawls amove from the path of movement of the firing chamber to permit the firing chamber to move to its in battery position whereupon the chambered round is fired to complete another firing cycle. This cycling repeats itself automatically as long as the drive motor for the firing chamber is activated and the ammunition supply lasts or until the firing chamber drive motor is intentionally deactivated.

Figure 5:
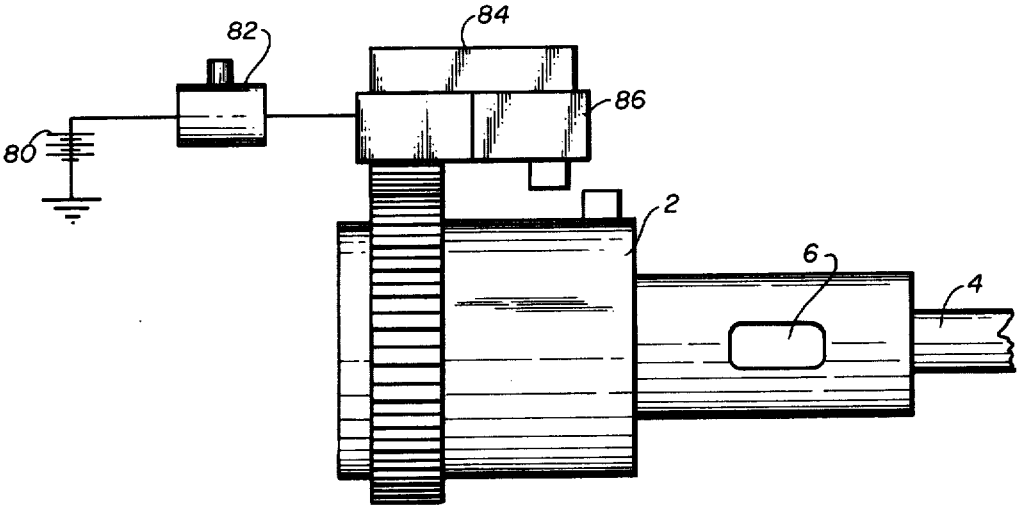
FIG. 5 illustrates a conventional firing circuit diagram capable of use with the present invention.

Schematically shown in FIG. 5 is a conventional firing circuit diagram for the reciprocating firing chamber. A power source 80 electrically in series with an on-off actuator 82, as shown a push button, actuates the drive motor 84 for the firing chamber to cause linear movement of the firing chamber. With the firing button 82 depressed, the weapon firing chamber cycles continuously until the ammunition is expended. Either when the ammunition is expended or the firing button released, the electrical time delay relay device 86 permits the firing chamber motor 84 to continue cycling of the firing chamber to complete one additional round firing independent of the preceding round firing cycle when the firing button is released and return the firing chamber to its full out of battery position. By the synchronization of the cam actuator 50 with the firing chamber 10 the feed pawl 24 is in position to feed the next round into the receiver opening and the ejection pawl 26 is in position to permit ejection of the spent round from the receiver outlet 8.

It will be appreciated that the present invention provides new and improved means for controlling feed, positioning and ejection of rounds of an automatic weapon system having a reciprocating firing chamber by utilization of a cam actuator rotatably synchronized to the movement of the firing chamber to control operation of round feed and ejection stop pawls.

It will be understood that, while only a single embodiment of the present invention has been shown and described, many variations and improvements will become readily apparent to one skilled in the art, and that this invention is to be only limited by the scope of the following claims.

I claim:

1. In an automatic weapon system including a receiver having a round receiving opening with a feed inlet and an ejection outlet, a reciprocable firing chamber carrying a bolt and firing mechanism between in and out of battery positions, means for reciprocating said firing chamber, and a feed tray mechanism for indexing rounds in position for introduction into the receiver opening, the improvement comprising:

a cam actuated round feed, positioning and ejection assembly, said assembly including:

feed pawl means having a round receiving position and a round stop position, ejection stop means having one limiting position to permit unobstructed ejection of a spent round casing from the receiver opening, a second limiting position, and an intermediate position in the receiver opening to obstruct movement and to permit centering of a round in the receiver opening in cooperation with the feed pawl means when in its round stop position, cam follower means carried by the feed pawl means for moving the feed pawl means between said positions, cam follower means carried by the ejection stop means for moving the ejection stop means between said intermediate and limiting positions, and cam follower actuator means carried by the receiver for operating said cam follower means to synchronize movement of said pawl means between said positions to permit round feeding, positioning and ejection sequentially and repetitively in response to the movement of the firing chamber.

2. The system of claim 1 in which the cam actuator means is rotatable and is coaxial with said receiver, and including means for rotating said cam actuator means.

3. The system of claim 2 wherein said cam actuator means has a face sursface provided with a pair of closed loop cam paths, one for each of the cam follower means.

4. The system of claim 3 wherein the cam paths are formed in a face of the cam actuator means which is stepped in cross section to provide upper and lower cam paths.

5. The system of claim 4 wherein one of the cam paths is a continuous groove.

6. The system of claim 5 wherein the lower cam path is the continuously grooved cam path.

7. The system of claim 6 wherein the cam follower means for the ejection stop means rides in the grooved lower cam path.

8. The system of claim 7 wherein the upper cam path has a grooved section communicating with an ungrooved section and has a section open to the lower cam path and the feed cam actuator means rides in said grooved section to pivot the feed pawl means between said positions in contact with said ungrooved section and floats over said open section.

9. The system of claim 8 wherein said feed pawl means includes a bracket mounted to the receiver, a pair of spaced arcuate pawl members in the bracket, a pivot pin extending between said pawl members and through said bracket and wherein said cam follower means comprises an elongated arm pivoted at one end adjacent to said pivot pin and carrying a cam roller at its other end.

10. The system of claim 9 wherein said ejector pawl means includes a bracket mounted to the receiver, a pawl member in the bracket, and a pivot pin extending through said bracket and pawl member and said ejection stop cam follower means includes an elongaged arm pivoted at one end adjacent to one end of the ejector stop pawl pivot pin and carrying a cam roller at its other end that travels in the ejector stop cam actuator groove.

11. The system of claim 10 wherein said firing chamber includes a pair of spaced extensions which cooperate with the feed and ejection stop pawl means to center each round coaxially with the firing chamber.

12. In an automatic weapons system including a receiver having a round receiving opening therethrough with a feed inlet and an ejection outlet, and a reciprocable firing chamber in the receiver movable between in and out of battery positions, the improvement comprising:

round feed means having a round receiving position and a round stop position, ejection stop means having a limiting ejection position, a second limiting position and an intermediate round stop position for cooperating with the round feed means when in its round stop position to center a round in the receiver, movable cam means carried by the round feed means and ejection stop means for moving the round feed means and ejection stop means between said positions, and means for actuating movement of said movable cam means.

13. The system of claim 12 wherein said movable cam means are pivotably movable cam means.

* * * * *